US007178697B2

(12) United States Patent
Brundick et al.

(10) Patent No.: US 7,178,697 B2
(45) Date of Patent: Feb. 20, 2007

(54) AGITATOR ASSISTED BULK PRODUCT DISPENSER

(75) Inventors: Ronald Brundick, Roland, AR (US); Christopher Relyea, Columbus, OH (US)

(73) Assignee: Trade Fixtures, LLC, Little Rock, AR (US)

( * ) Notice: Subject to any disclaimer, the term of this patent is extended or adjusted under 35 U.S.C. 154(b) by 141 days.

(21) Appl. No.: 11/008,386

(22) Filed: Dec. 9, 2004

(65) Prior Publication Data

US 2005/0269366 A1 Dec. 8, 2005

Related U.S. Application Data

(60) Provisional application No. 60/572,539, filed on May 19, 2004.

(51) Int. Cl.
*B67D 5/06* (2006.01)

(52) U.S. Cl. ..... 222/181.1; 222/505; 222/185.1; 222/243; 222/564

(58) Field of Classification Search ..... 222/185.1, 222/181.1, 186, 196.1, 556, 242, 243, 505, 222/247, 511, 517, 518, 544, 564, 226
See application file for complete search history.

(56) References Cited

U.S. PATENT DOCUMENTS

| | | | | | |
|---|---|---|---|---|---|
| 557,274 | A | | 3/1896 | Kade | |
| 670,792 | A | | 3/1901 | Lippincott | |
| 1,184,379 | A | | 5/1916 | Ritter | |
| 1,224,136 | A | | 5/1917 | Caskey | |
| 1,225,797 | A | | 5/1917 | Gardner | |
| 1,771,545 | A | | 7/1930 | Melvin | |
| 1,931,908 | A | * | 10/1933 | Tillotson | 222/243 |
| 2,410,410 | A | * | 11/1946 | Garubo | 222/184 |
| 2,527,749 | A | * | 10/1950 | Lundeen | 141/378 |
| 2,551,765 | A | * | 5/1951 | Sedor | 222/129 |
| 3,138,297 | A | * | 6/1964 | McKinney | 222/185.1 |
| 4,318,577 | A | | 3/1982 | Vona | |
| 4,349,128 | A | | 9/1982 | Sanfilippo | |
| 4,562,941 | A | | 1/1986 | Sanfilippo | |
| 4,592,494 | A | | 6/1986 | Ellis et al. | |
| 4,619,379 | A | * | 10/1986 | Biehl | 222/153.14 |
| 4,718,578 | A | | 1/1988 | Radek et al. | |
| 4,802,609 | A | | 2/1989 | Morse et al. | |
| 4,903,866 | A | | 2/1990 | Loew | |

(Continued)

OTHER PUBLICATIONS

Product Catalog, NewLeaf Designs, 1997, pp. 4-7, Vita-Bin(R) bin systems.

(Continued)

*Primary Examiner*—Kevin Shaver
*Assistant Examiner*—Stephanie E. Tyler
(74) *Attorney, Agent, or Firm*—Eley Law Firm Co.; James R. Eley; Michael A. Forhan

(57) ABSTRACT

A dispenser having an agitator for bulk product. The dispenser comprises a housing, a handle pivotally connected to the housing, a door connected to the handle and adapted to pivot between a closed position and an open position to selectively dispense the bulk product through an opening in the housing, and an agitator disposed within the housing and connected to the door. The agitator moves when the handle is pivoted, enabling the bulk product to flow by gravity toward the opening.

19 Claims, 6 Drawing Sheets

U.S. PATENT DOCUMENTS

| | | | |
|---|---|---|---|
| 5,105,991 | A | 4/1992 | Johnson |
| 5,308,158 | A | 5/1994 | Vogelgesang et al. |
| 5,437,393 | A | 8/1995 | Blicher et al. |
| 5,551,604 | A | 9/1996 | Kern et al. |
| 5,560,519 | A | 10/1996 | Moore et al. |
| 6,182,864 | B1 | 2/2001 | Elmore |
| 6,241,123 | B1 | 6/2001 | Elmore |
| 6,571,990 | B2 * | 6/2003 | Bird ..... 222/185.1 |

OTHER PUBLICATIONS

Product lterature, Bestbins Corporation, 4 gal. and 8 gal. gravity feed bins with assembly instructions.

Product literature, Trade Fixtures NewLeaf Designs, gravity and scoop feed bins, May 10, 2004, http://www.tradefixtures.com/bins/newleaf.htm.

* cited by examiner

AGITATOR ASSISTED BULK PRODUCT DISPENSER

This application claims priority to U.S. provisional application 60/572,539, filed May 19, 2004, the contents of which are hereby incorporated by reference.

RELATED PATENTS

U.S. Pat. Nos. 6,182,864 and 6,241,123 to Elmore, both of which teach general gravity fed dispensing systems. The teachings of both patents are incorporated herein by reference.

FIELD

The invention relates generally to a bulk material dispensing apparatus and, more particularly, to a gravity fed dispensing apparatus with agitation means. The apparatus allows stored bulk material, including difficult-to-dispense items, to flow under the force of gravity with the assistance of an agitator. The items are then dispensed through a chute.

BACKGROUND

Gravity fed bins for dispensing bulk materials are used to dispense a wide variety of materials having a range of sizes and aggregate make-ups as diverse as hardware components, e.g., nuts and bolts, to food, e.g., pastas, cereals, nuts, coffee (either beans or ground), dried soup mixes, candies, spices, and the like. Generally, the bins are comprised of enclosures having an inlet at an upper end utilized to fill a cavity, an outlet or chute at its lower end utilized to dispense the material, and a flow control device located between the upper and lower openings for controlling the amount of material being dispensed during the time the control device is actuated. In operation, as the material is being dispensed, gravity pulls the remaining material in the cavity towards the lower end to replace the dispensed material. These types of bins generally include a downwardly angled or curving inner wall that forms a slide to channel the dispensed materials into a receptacle adjacent the outlet. Examples of prior art gravity fed bins can be found in the above-mentioned U.S. Patents to Elmore, U.S. Pat. No. 4,903,866 to Loew, NewLeaf Designs' Vita-Bin® gravity bin product, and Best-Bins Corporation's gravity bins product.

Gravity fed bins offer a multitude of advantages compared to other dispensing means, such as scoop bins, including convenience, ease of use and hygiene. Even so, gravity fed bins are not suited for all types of materials, thus preventing them from being more widely adopted. Specifically, gravity fed dispensers are not generally well suited for dispensing sticky products, such as dried fruits and gummy candies or bulk materials that tend to bridge over the dispensing area, such as ground foods and wrapped candies, for example.

Heretofore, the most practical means for dispensing such difficult to dispense product was to employ a bulk food dispenser generally known as a "scoop bin." As the name suggests, a scoop bin typically comprises a plastic bin, often having a hinged lid that is lifted to provide the consumer access to the stored contents. A hand scoop is then employed to gather the bulk product for placement into a container. While scoop bins are effective for dispensing a wider variety of product than a gravity type dispenser, they suffer from several major disadvantages, particularly in the area of hygiene, because of the contamination that can take place in these types of dispensers. Sources of contamination include germs that may be attached to the scoop or scoop handle being transferred to the stored product during dispensing or from external debris falling into the bin cavity when the bin's lid is lifted. Lastly, since the nature of scoop bins requires their openings to be located closer to the floor for access reasons, they are generally within the reach of children and others who are not hesitant to reach into the unsecured bins with potentially unclean hands in order to extract a sample, or even play with the bin contents.

Attempts have been made to address one or more of these problems. For example, U.S. Pat. No. 4,318,577 to Vona shows bins for displaying such things as buns wherein the bins include a sneeze shield and a lower cleaning tray. U.S. Pat. No. 5,105,991 to Johnson shows a relatively hygienic system incorporating a rake with an externally accessible handle. U.S. Pat. No. 4,718,578 to Radek et al., shows another such rake system, as does U.S. Pat. No. 4,592,494 to Ellis et al. U.S. Pat. No. 4,802,609 to Morse et al. shows yet another variation, in which an auger is used to draw material out of a hopper or receptacle. U.S. Pat. No. 5,551,604 to Kern et al. shows a relatively hygienic system that uses a wiping paddle arrangement and flexible chute walls to accommodate sticky foods. Unfortunately, each of these attempts have failed to become widely used because of a number of shortcomings, including difficulty in use and cleaning, which renders them impractical for their intended purpose.

There remains a need for a reliable bulk product dispenser that can be easily cleaned, whose contents are not easily accessible nor prone to external contamination, that can accommodate a wide variety of product shapes and is suitable for dispensing product portions that tend to clump or otherwise stick together and resist gravity-fed flow.

SUMMARY

The invention disclosed herein addresses and overcomes the shortcomings inherent in previous attempts in the art to dispense difficult product. In particular, the present invention overcomes the tendency of components of the stored product to exert tactile pressure upon each other such that the components bridge a dispensing opening in the housing or clump together. The present invention provides for an agitation means located within the bin and which is actuated upon pulling the dispensing handle. One important aspect of the invention is that the agitator is configured so that the direction of the agitation is reversible. For example, the agitator may be configured to either draw product toward the dispensing chute when the dispensing handle is actuated or to push it away, the particular configuration depending upon the type and physical characteristics of the product being dispensed.

Another aspect of the invention is a movable baffle plate that is adjustable to reduce the tendency of stored product to resist the force of gravity through bridging of a dispensing opening. It may also be adjusted to regulate the flow rate of dispensed product when the handle is actuated.

The bulk product dispenser according to the present invention is preferably constructed of molded clear plastic, such as polycarbonate, but other materials and color configurations are anticipated. For food related dispensers, it is also preferable to utilize materials that have been approved by the U.S. Food and Drug Administration and constructed in accordance with food service specifications issued by NSF International of Ann Arbor, Mich.

One aspect of the invention is an embodiment of a dispenser for bulk product. The dispenser comprises a housing having an opening, a handle pivotally connected to the housing, a door connected to the handle and adapted to pivot between a closed position and an open position when actuated to selectively dispense the bulk product through the opening, and an agitator in contact with the bulk product and disposed within the housing and connected to the door. The agitator moves when the handle is pivoted, breaking up the product and enabling the bulk product to flow by gravity toward the opening.

Another aspect of the invention is another embodiment of a dispenser for bulk product. The dispenser comprises a housing having an opening, a handle pivotally connected to the housing, a door connected to the handle and adapted to pivot between a closed position and an open position when actuated to selectively dispense the bulk product through the opening, at least one link connected to the door, and an agitator disposed within the housing, in contact with the bulk product and being connected to the link. The link is pivotally coupled to the door at one of a first position or a second position. Coupling to the first position causes the agitator to move slidably toward a rear of the housing as the door pivots to the open position, and move slidably toward a front of the housing as the door pivots to the closed position. Coupling to the second position causes the agitator to move slidably toward the front of the housing as the door pivots to the open position, and move slidably toward the rear of the housing as the door pivots to the closed position. The agitator breaks up and/or loosens and/or repositions the bulk product, enabling it to flow by gravity toward the opening.

Yet another aspect of the present invention is a method for dispensing bulk product. The method comprises the steps of providing a housing having an opening, connecting a door to the housing, the door being pivotable with a handle and actuable between a closed position and an open position to selectively allow bulk product through the opening, and placing an agitator within the housing in contact with the bulk product and connecting the agitator to the door such that the agitator moves when the door is pivoted, enabling the bulk product to flow toward the opening.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
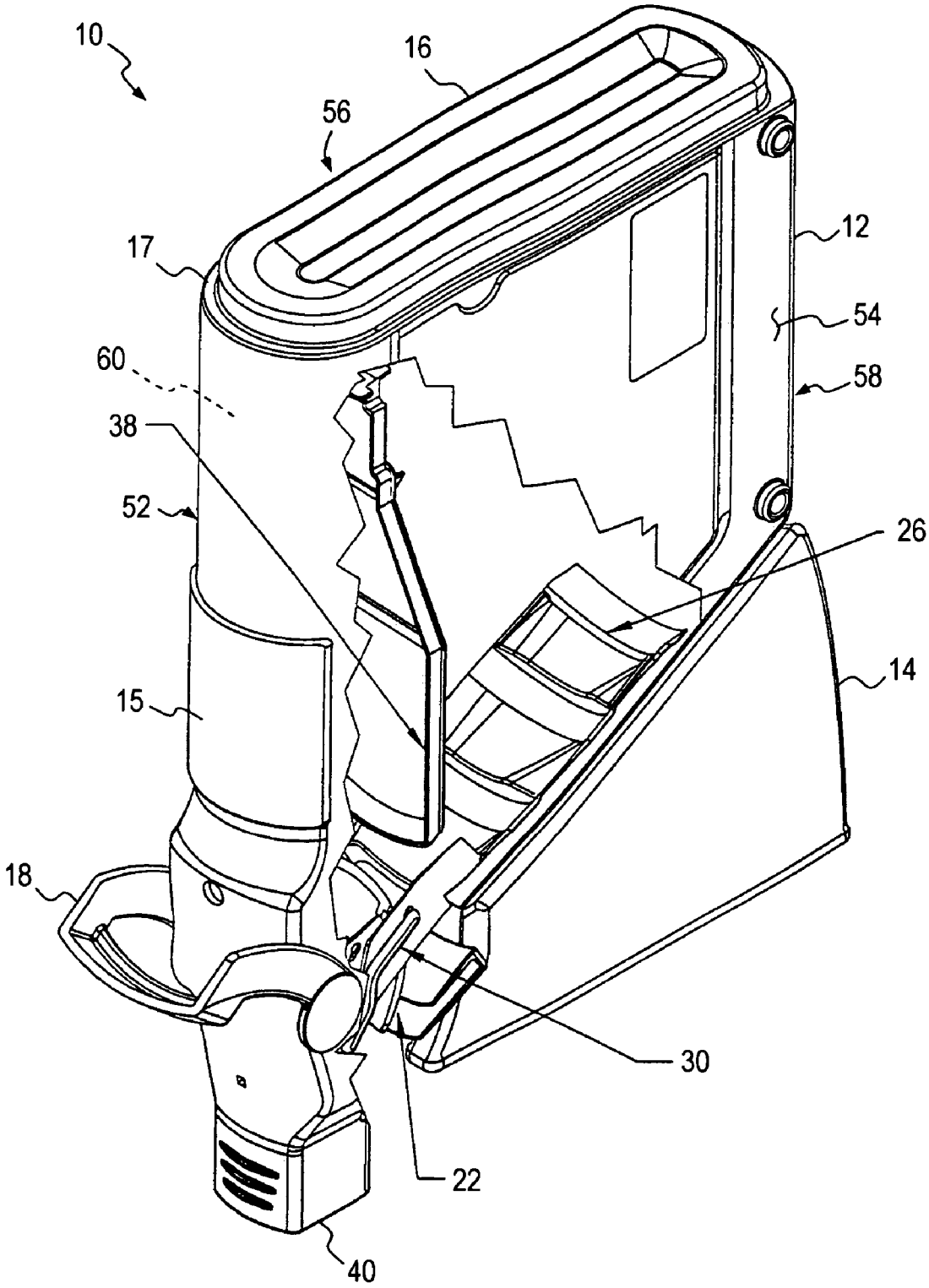
FIG. 1 is a perspective view of a bulk product dispenser with agitator according to an embodiment of the present invention, shown in cutaway.
Figure 2A:
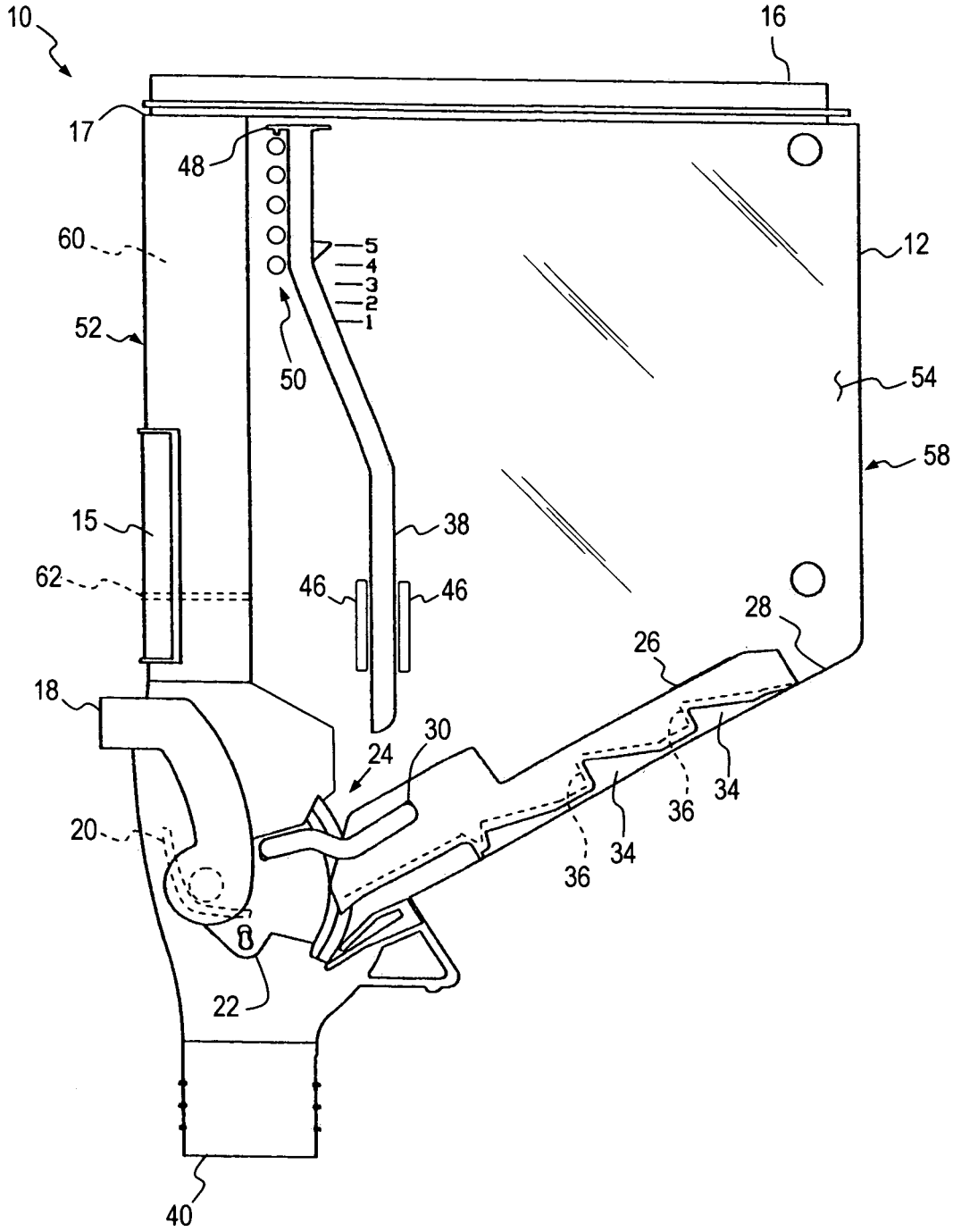
FIG. 2A depicts an elevational view in section of the bulk product dispenser of FIG. 1, showing the dispenser at rest.
Figure 2B:
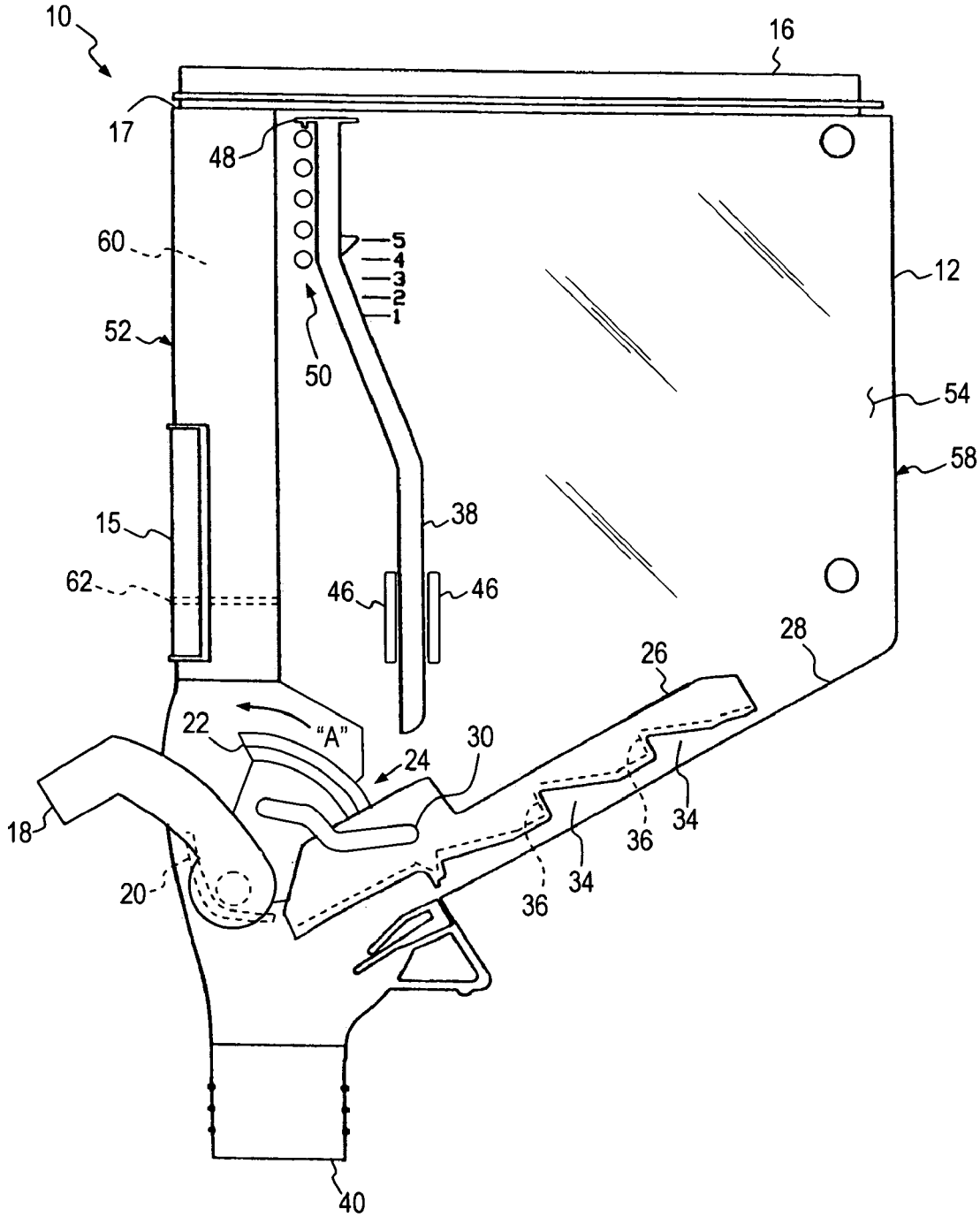
FIG. 2B shows an elevational view in section of the bulk product dispenser of FIG. 1, showing the dispenser in a dispensing state.

A bulk product dispenser 10 according to an embodiment of the present invention is shown in FIGS. 1, 2A and 2B. Dispenser 10 includes a housing 12 for storing bulk product. Housing 12 is mounted to a base 14, and may include a holder 15 for a label (not shown) to identify and describe bulk product stored therein.

A lid 16 fits onto a top 17 of housing 12 to keep out dirt and debris and to provide access to the interior of the housing for replenishing bulk product. Lid 16 may be removable or hinged, and may be held in place in any conventional manner, such as mating projections on the lid and housing 12.

A handle 18 is pivotally attached to housing 12. A door 22 is attached to handle 18 such that the door pivots when the handle is pivoted. Door 22 is arranged to selectively block an opening 24 of housing 12, preventing the discharge of product (not shown for clarity) stored in the housing.

Handle 18 and door 22 are held in a predetermined (closed) position by a biasing element 20 such that the door blocks opening 24 when the handle is not being actuated by a user. Biasing element 20 may be any conventional structure effective to hold handle 18 in the predetermined position including, without limitation, elastic materials, helical springs and leaf springs.

Figure 3:
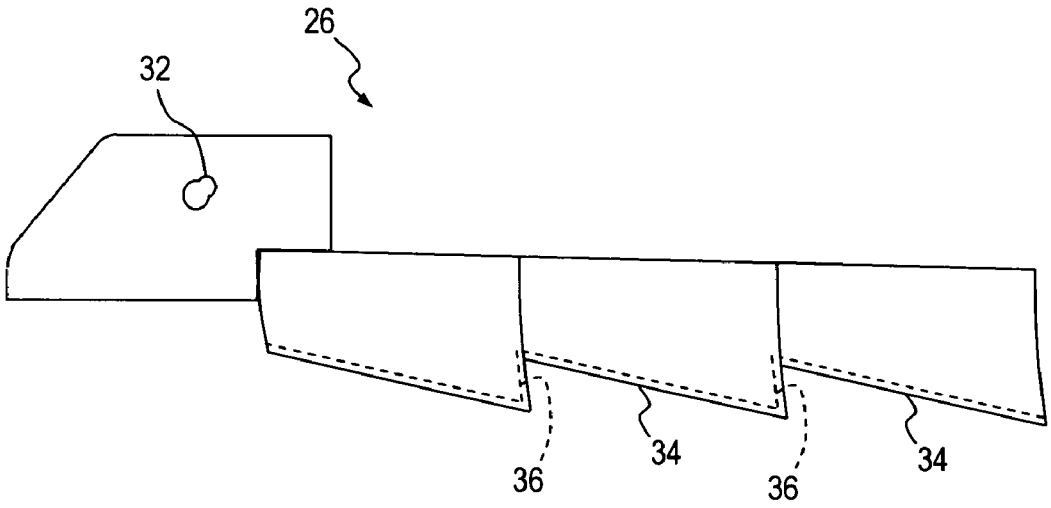
FIG. 3 is a side elevational view of the agitator of FIG. 1.

An agitator 26 is positioned proximate a bottom surface 28 of housing 12 and is coupled to door 22 by a pair of links 30 such that the agitator moves slidably and reciprocably along the bottom surface when handle 18 is pivoted reciprocably away from and toward housing 12. Agitator 26, shown in greater detail in FIGS. 3, 4A and 4B, includes a pair of openings 32 and one or more ribs 34 forming one or more faces 36. Faces 36 are oriented generally perpendicular to bottom surface 28, as shown in FIGS. 2A and 2B.

With reference to FIGS. 1, 2A and 2B, a baffle 38 is generally vertically disposed within housing 12 and is vertically adjustable to control or limit the flow of product from the housing. The vertical adjustment may be accomplished in any conventional manner including, without limitation, stays, stops, snaps, connectors, slots and tabs. In one embodiment, baffle 38 moves generally vertically through a pair of guides 46 on each sidewall 54, 56 of housing 12 and is held in one of a number of predetermined positions by a pair of tabs 48 of the baffle in cooperation with two of a plurality of projections 50, each being located on or molded into one of the sidewalls. Baffle 38 is in contact with the stored bulk product and provides a damming effect to control or limit the flow of product from housing 12. Baffle 38 additionally serves to effectively adjust the size and shape of housing 12 proximate opening 24 to accommodate various types and shapes of bulk product so as to prevent bridging of the product, i.e., product spanning across the opening in such a way that a "logjam" blockage occurs, preventing dispensing of the product.

Housing 12 may also include a detachable false front portion 52. False front 52 forms a cavity 60 within housing 12. When dispenser 10 is filled with bulk product, a portion of the product is placed into cavity 60, giving consumers a visual indication of the product stored within the dispenser. False front 52 may further include a removable drain door 62, closing off a lower portion of cavity 60. If drain door 62 is installed, the bulk product in cavity 60 will be retained in the cavity regardless of the amount of product in housing 12, making dispenser 10 always appear to be full. If drain door 62 is removed, product in cavity 60 will be dispensed along with product in housing 12, such that no product will be in the cavity when the housing is empty. Drain door 62 is preferably installed in the present invention so as to prevent product flow from cavity 60 from interfering with product flow from housing 12 when product is being dispensed.

With continued reference to FIGS. 1, 2A and 2B, in operation, lid 16 is separated from housing 12 and baffle 38 is vertically adjusted such that opening 24 is sized for a desired product type (i.e., gummy, wrapped, etc.), shape and dispensing flow rate. Housing 12 is filled with a bulk product to be dispensed, then lid 16 is reattached to housing 12. A user pulls on handle 18, causing the handle to pivot as it moves away from housing 12. Door 22 likewise pivots, moving to an open position and exposing opening 24, allowing bulk product to flow through the opening for dispensing. A chute 40 may be used to guide and direct the bulk product into a container (not shown) as it exits housing 12. As handle 18 and door 22 pivot, agitator 26 moves slidably along bottom surface 28 of housing 12, causing faces 36 of the agitator to contact the bulk product, aiding to loosen and enable the bulk product to flow toward opening 24. Handle 18 may be repeatedly actuated by the user, causing agitator 26 to reciprocably move along bottom surface 28 as door 22 opens and closes such that faces 36 repeatedly contact the bulk product to further aid in loosening and enabling its flow.

Figure 4A:
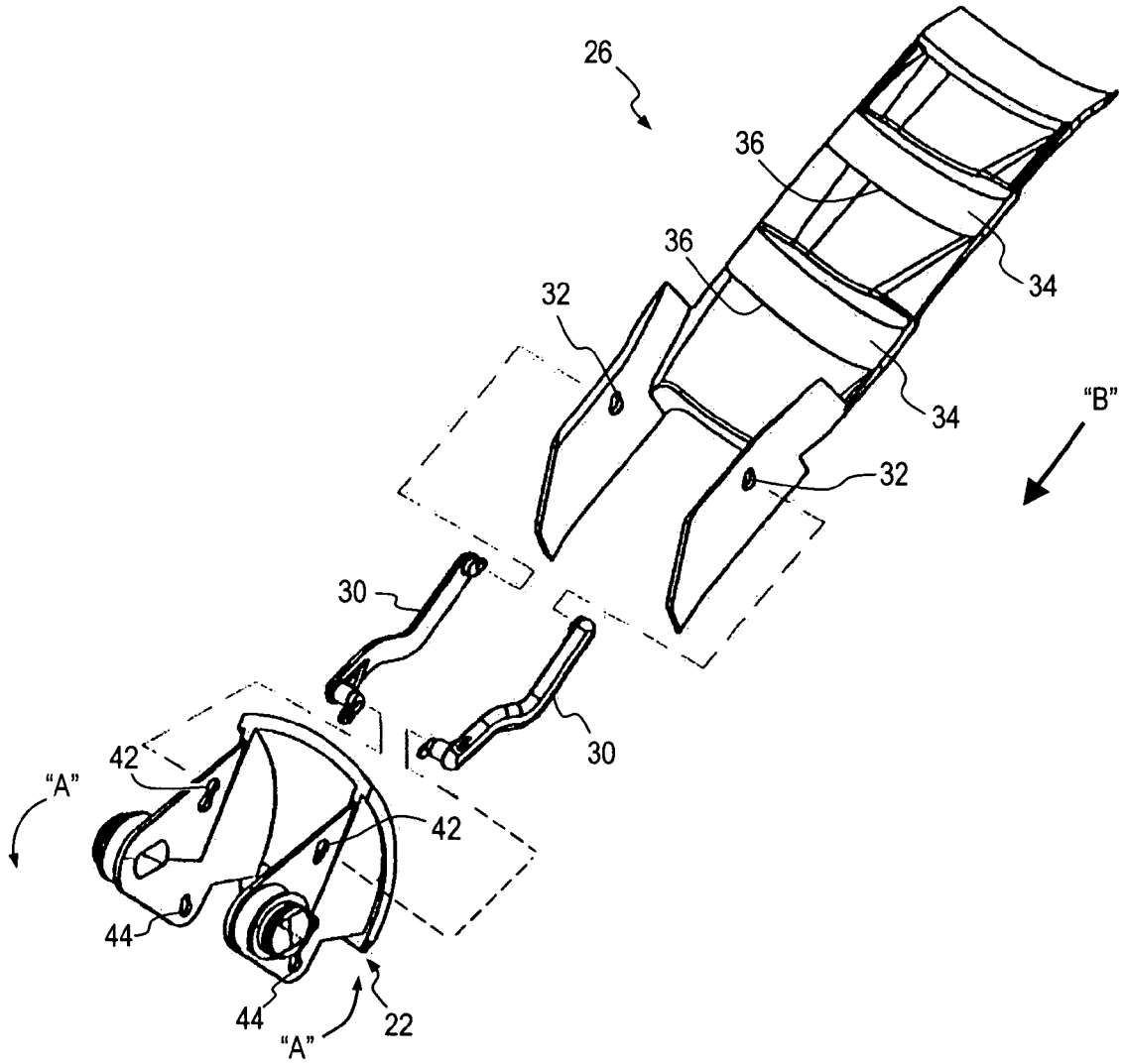
FIG. 4A is an exploded perspective view of component parts of the bulk product dispenser, configured to agitate the product toward the front of the housing according to an embodiment of the present invention.

The inventors have found that it is advantageous to tailor the movement of agitator 26 for differing types of bulk product to optimize the effectiveness of the agitator. With continued reference to FIGS. 2A and 2B, an exploded view of agitator 26 coupled to door 22 by links 30 is shown in FIG. 4A. A first end of each link 30 is pivotally attached to agitator 26 at openings 32. A second end of each link 30 is pivotally attached to openings 42 of door 22. When handle 18 is pulled by a user (i.e., pivoted away from housing 12), door 22 will pivot in axis "A." Movement of door 22 causes links 30 to move generally axially, pulling agitator 26 in direction "B," generally toward the door. In this configuration, faces 36 of agitator 26 push against the bulk product when handle 18 is pulled, loosening the bulk product and enabling its flow. Agitation in this manner is particularly effective for aiding to dispense soft and "gummy" bulk product.

Figure 4B:
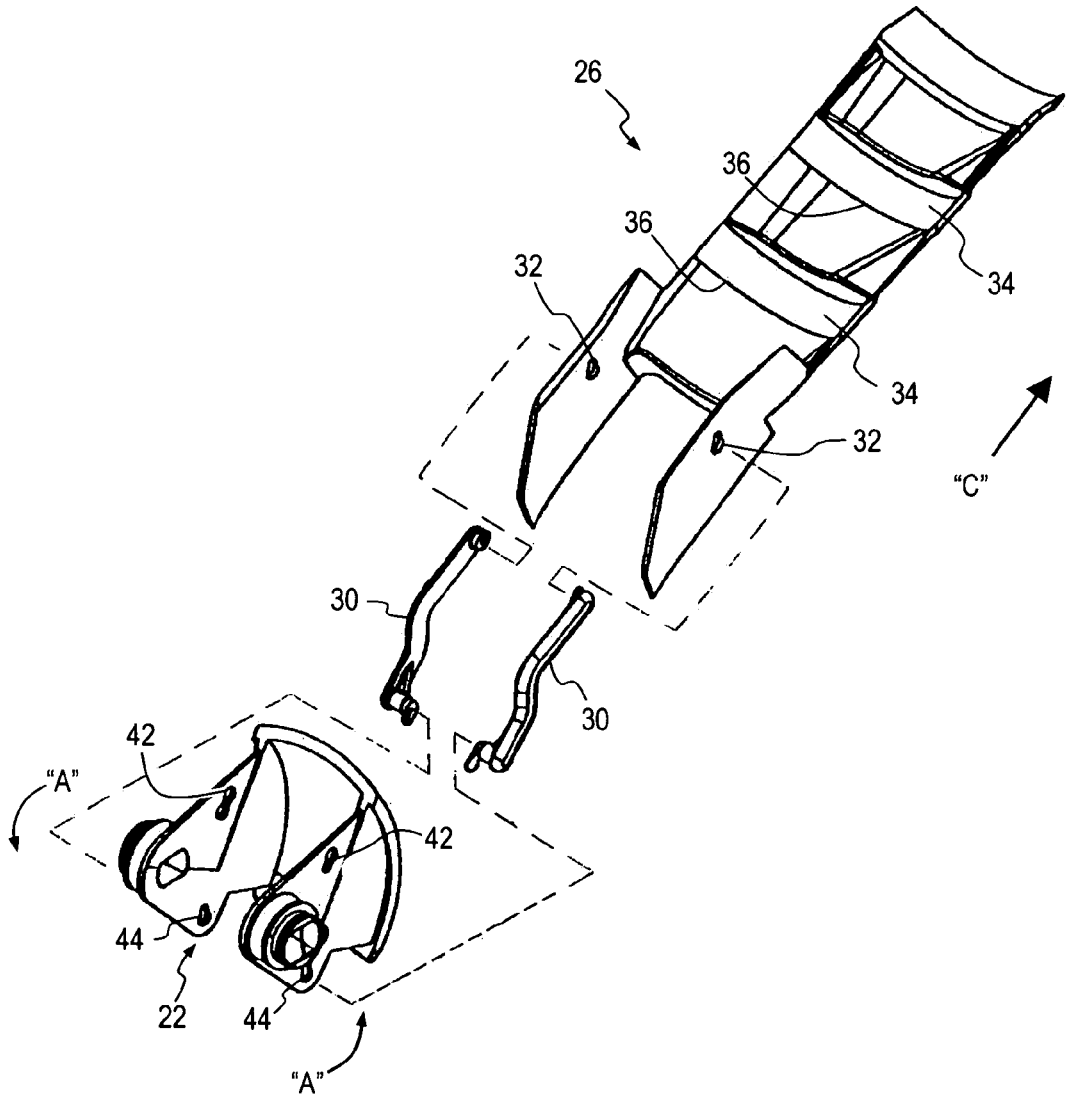
FIG. 4B is an exploded perspective view of component parts of the bulk product dispenser configured to agitate the product toward the rear of the housing according to an embodiment of the present invention.

The present invention may also be configured as depicted in FIG. 4B. A first end of each link 30 is pivotally attached to agitator 26 at openings 32. A second end of each link 30 is pivotally attached to openings 44 of door 22. In this configuration, when handle 18 (see generally FIG. 1) is pulled by a user, door 22 will pivot in axis "A." Movement of door 22 causes links 30 to move generally axially, pushing agitator 26 in direction "C," generally toward a rear 58 of housing 12. In this configuration, faces 36 of agitator 26 push against the bulk product when handle 18 is urged to its resting position proximate housing 12 by biasing element 20 and/or pushed by the user, loosening the bulk product and enabling its flow. Agitation in this manner is particularly effective for aiding to dispense dry or wrapped bulk product that has a tendency to bridge.

As can be seen, dispenser 10 may be adapted to function in the manner described above for either FIG. 4A or FIG. 4B by simply positioning the second ends of links 30 in either openings 42 or openings 44 of door 22. No further modification of dispenser 10 is required.

Any suitable materials may be selected for dispenser 10 and its associated components. For example, housing 12 may be a clear plastic including, without limitation, "food-safe" plastics, polycarbonates and acrylics, allowing a user to view the contents of dispenser 10. Other components, such as base 14 (see FIG. 1) may be a colored plastic. For example, in some embodiments it may be desirable to color-code portions of dispenser 10 so that dispensers containing similar bulk products, such as types of candy, may be grouped together for the convenience of the user. Another criterion for dispenser 10 is selecting materials compatible with the bulk product to be dispensed, such as materials of sufficient strength and durability to bear the weight of heavy bulk product. Yet another criterion is selecting materials of a chemical composition that is compatible with the bulk product, such as avoiding materials that support galvanic corrosion in certain metal bulk products.

While this invention has been shown and described with respect to a detailed embodiment thereof, it will be understood by those skilled in the art that changes in form and detail thereof may be made without departing from the scope of the claims of the invention.

What is claimed is:

1. A dispenser for bulk product, comprising:

a housing having an opening and an interior bottom surface;

a handle pivotally connected to the housing;

a door connected to the handle and adapted to pivot between a closed position and an open position when actuated to selectively dispense the bulk product through the opening; and an agitator having at least one face oriented generally perpendicular to the bottom surface of the housing and positioned within the housing proximate the bottom surface and substantially below the bulk product and connected to the door, wherein the agitator moves when the handle is pivoted, enabling the bulk product to flow toward the opening.

2. The dispenser of claim 1 wherein the agitator moves slidably and reciprocably as the handle is pivoted.

3. The dispenser of claim 1 wherein the agitator is connected to the door by at least one link.

4. The dispenser of claim 3 wherein the link is pivotally coupled to the door at one of a first position or a second position, the first position causing the agitator to move slidably toward a rear of the housing as the door pivots to the open position, and move slidably toward a front of the housing as the door pivots to the closed position; and the second position causing the agitator to move slidably toward the front of the housing as the door pivots to the open position, and move slidably toward the rear of the housing as the door pivots to the closed position.

5. The dispenser of claim 4 wherein the coupling of the link with the door is selectable between the first and second positions.

6. The dispenser of claim 1, further comprising a baffle in contact with the product to limit the flow of product toward a front of the housing.

7. The dispenser of claim 6 wherein the baffle is adjustable to adjust the flow of product from the housing.

8. The dispenser of claim 1, further comprising a chute to guide and direct bulk product being dispensed.

9. The dispenser of claim 1, further comprising a base.

10. The dispenser of claim 1, further comprising a biasing element to bias the door in the closed position.

11. A dispenser for bulk product, comprising:

a housing having an opening;

a handle pivotally connected to the housing;

a door connected to the handle and adapted to pivot between a closed position and an open position when actuated to selectively dispense the bulk product through the opening;

at least one link connected to the door; and an agitator disposed within the housing, in contact with the bulk product and connected to the link, wherein the link is pivotally coupled to the door at one of a first position or a second position, the first position causing the agitator to move slidably toward a rear of the housing as the door pivots to the open position, and move slidably toward a front of the housing as the door pivots to the closed position, and the second position causing the agitator to move slidably toward the front of the housing as the door pivots to the open position, and move slidably toward the rear of the housing as the door pivots to the closed position, the agitator enabling the bulk product to flow toward the opening.

12. A method for dispensing bulk product, comprising the steps of:

providing a housing having an opening and an interior bottom surface;

connecting a door to the housing, the door being pivotable with a handle and actuable between a closed position and an open position to selectively allow bulk product through the opening; and placing an agitator having at least one face oriented generally perpendicular to the bottom surface within the housing proximate the bottom surface and substantially below and in contact with the bulk product and connecting the agitator to the door such that the agitator moves when the door is pivoted, enabling the bulk product to flow toward the opening.

13. The method of claim 12, further comprising the step of moving the agitator slidably and reciprocably as the handle is pivoted.

14. The method of claim 13, further including the step of adding at least one face to the agitator and orienting the face generally perpendicular to a bottom surface of the housing.

15. The method of claim 14, further including the step of moving the face toward a front of the housing as the door pivots to the open position and moving the face toward a rear of the housing as the door pivots to the closed position.

16. The method of claim 14, further including the step of moving the face toward a rear of the housing as the door pivots to the open position and moving the face toward a front of the housing as the door pivots to the closed position.

17. The method of claim 12, further including the step of connecting the agitator to the door with at least one link.

18. The method of claim 17, further including the step of pivotally coupling the link to the door at one of a first position or a second position, the first position causing the agitator to move slidably toward a rear of the housing as the door pivots to the open position, and move slidably toward a front of the housing as the door pivots to the closed position; and the second position causing the agitator to move slidably toward the front of the housing as the door pivots to the open position, and move slidably toward the rear of the housing as the door pivots to the closed position.

19. The method of claim 18, further including the step of making the coupling of the link to the door selectable between the first and second positions.

* * * * *